US010100553B1

(12) United States Patent
Roth et al.

(10) Patent No.: US 10,100,553 B1
(45) Date of Patent: Oct. 16, 2018

(54) LOCK THAT MECHANICALLY DETECTS TAMPERING

(71) Applicant: Amazon Technologies, Inc., Seattle, WA (US)

(72) Inventors: Gregory Branchek Roth, Seattle, WA (US); Alexander Zissis Ginos, Kirkland, WA (US)

(73) Assignee: Amazon Technologies, Inc., Seattle, WA (US)

( * ) Notice: Subject to any disclaimer, the term of this patent is extended or adjusted under 35 U.S.C. 154(b) by 132 days.

(21) Appl. No.: 15/199,746

(22) Filed: Jun. 30, 2016

Related U.S. Application Data

(62) Division of application No. 13/747,278, filed on Jan. 22, 2013, now Pat. No. 9,394,723.

(51) Int. Cl.

| | |
|---|---|
| ***E05B 11/06*** | (2006.01) |
| ***E05B 27/00*** | (2006.01) |
| ***E05B 47/06*** | (2006.01) |
| ***E05B 47/00*** | (2006.01) |

(52) U.S. Cl.
CPC ..... *E05B 11/06* (2013.01); *E05B 27/006* (2013.01); *E05B 47/0005* (2013.01); *E05B 47/0661* (2013.01); *E05B 2047/002* (2013.01); *E05B 2047/0067* (2013.01)

(58) Field of Classification Search
CPC ..... E05B 47/0001; E05B 47/0012; E05B 47/026; E05B 47/02; E05B 47/00; E05B 47/0004; E05B 2047/0086; E05B 2047/0058; E05B 2047/002; E05B 2047/0067; E05B 27/05; E05B 27/006; E05B 11/06; E05B 47/005; E05B 47/0661
USPC ..... 70/490, 492, 493, 416, 419–421, 378, 70/434, 276, 277, 278.1–278.3, 278.6, 70/278.7, 279.1–283.1, 367–369
See application file for complete search history.

(56) References Cited

U.S. PATENT DOCUMENTS

| | | | |
|---|---|---|---|
| 1,666,319 | A | 4/1928 | Watts et al. |
| 1,946,364 | A | 2/1934 | Smith et al. |
| 2,057,301 | A | 10/1936 | Boris et al. |
| 2,769,873 | A | 11/1956 | Noregaard et al. |
| 3,266,278 | A | 8/1966 | Ennitt et al. |
| 3,284,593 | A | 11/1966 | Maddison et al. |
| 3,402,581 | A | 9/1968 | Schweizer et al. |
| 3,464,243 | A | 9/1969 | Hawkins |
| 3,550,410 | A | 12/1970 | Toepfer et al. |
| 3,763,676 | A | 10/1973 | Greenberg et al. |

(Continued)

OTHER PUBLICATIONS

U.S. Appl. No. 13/747,278 , "Final Office Action", dated Dec. 21, 2015, 11 pages.

(Continued)

*Primary Examiner* — Suzanne L Barrett
(74) *Attorney, Agent, or Firm* — Kilpatrick Townsend & Stockton LLP

(57) ABSTRACT

Pin tumbler locks are provided that include features for detecting tampering. Tampering may be detected in a number of different ways. As an example, abnormal movement of one or more of the driver pins in a pin tumbler lock can be an indication of tampering. In addition, one or more sensors can be included at the end of a keyway that detect picking or bumping beyond the length of normal key insertion. A mechanical actuator can be used for detection.

20 Claims, 7 Drawing Sheets

(56) References Cited

U.S. PATENT DOCUMENTS

| | | | | |
|---|---|---|---|---|
| 3,798,398 | A * | 3/1974 | Hills | E05B 11/00 307/10.3 |
| 3,936,673 | A | 2/1976 | Kelly et al. | |
| 3,941,954 | A | 3/1976 | Wintringham et al. | |
| 3,962,695 | A | 6/1976 | Peters et al. | |
| 3,986,376 | A | 10/1976 | Lack | |
| 4,205,542 | A | 6/1980 | Renda et al. | |
| 4,262,506 | A | 4/1981 | Tobel et al. | |
| 4,326,124 | A | 4/1982 | Faude et al. | |
| 4,328,692 | A | 5/1982 | Dice et al. | |
| 4,332,306 | A | 6/1982 | Turatti et al. | |
| 4,656,851 | A | 4/1987 | Leek et al. | |
| 4,712,398 | A | 12/1987 | Clarkson et al. | |
| 4,759,204 | A | 7/1988 | Neyret et al. | |
| 4,803,314 | A | 2/1989 | Sorenson et al. | |
| 4,982,587 | A | 1/1991 | Tzou | |
| 4,996,514 | A | 2/1991 | Sunami | |
| 5,177,466 | A | 1/1993 | Lai et al. | |
| 5,229,747 | A | 7/1993 | Zhao et al. | |
| 5,289,177 | A | 2/1994 | Wake et al. | |
| 5,461,360 | A | 10/1995 | Guim et al. | |
| 5,691,711 | A | 11/1997 | Jorgensen et al. | |
| 5,774,043 | A | 6/1998 | Mizuno et al. | |
| 5,836,187 | A | 11/1998 | Janssen et al. | |
| 5,838,232 | A | 11/1998 | Kim et al. | |
| 5,870,915 | A | 2/1999 | D'Hont et al. | |
| 6,000,609 | A | 12/1999 | Gokcebay et al. | |
| 6,523,381 | B1 | 2/2003 | Ritz et al. | |
| 6,756,698 | B2 | 6/2004 | Shamoto et al. | |
| 8,756,964 | B2 | 6/2014 | Wakai et al. | |
| 8,981,899 | B2 | 3/2015 | Jokinen et al. | |
| 9,394,723 | B1 | 7/2016 | Ginos et al. | |
| 9,567,770 | B1 * | 2/2017 | Ginos | E05B 35/001 |
| 2003/0084691 | A1 | 5/2003 | Kato et al. | |
| 2007/0209412 | A1 | 9/2007 | Shiramizu et al. | |
| 2008/0024270 | A1 | 1/2008 | Katagiri et al. | |
| 2009/0229326 | A1 | 9/2009 | Pukari et al. | |
| 2010/0139340 | A1 | 6/2010 | Gerner et al. | |
| 2010/0319420 | A1 | 12/2010 | Ng et al. | |
| 2011/0079059 | A1 | 4/2011 | Piotrowski et al. | |
| 2012/0118032 | A1 | 5/2012 | Baumann et al. | |
| 2013/0102285 | A1 | 4/2013 | Suginaka et al. | |

OTHER PUBLICATIONS

U.S. Appl. No. 13/747,278 , "Non-Final Office Action", dated Jun. 15, 2015, 8 pages.

U.S. Appl. No. 13/747,278 , "Notice of Allowance", dated Mar. 30, 2016, 15 pages.

U.S. Appl. No. 13/747,278 , "Supplemental Notice of Allowance", dated Jun. 15, 2016, 2 pages.

U.S. Appl. No. 13/747,320, filed Jan. 22, 2013, Titled: "Lock That Electronically Detects Tampering".

* cited by examiner

LOCK THAT MECHANICALLY DETECTS TAMPERING

CROSS REFERENCE TO RELATED APPLICATIONS

This application is a divisional of U.S. patent application Ser. No. 13/747,278, filed on Jan. 22, 2013, issued as U.S. Pat. No. 9,394,723 on Jul. 19, 2016, entitled "LOCK THAT MECHANICALLY DETECTS TAMPERING," the contents of which are herein incorporated by reference in their entirety.

BACKGROUND

Computer equipment, information and services often need protection from unintentional or unauthorized access, change or destruction. Many computer systems include software authorization components and security components. Such components can provide protection against a hacker or other unauthorized individual who is trying to access information on the computer devices.

Hacking is typically not the only concern. Data and computer equipment often need to be protected from tampering, physical access, or theft, such as where a thief steals a computer or components of a computer to later access data on the computer or to sell the hardware components. Hardware-based security can provide a solution to this issue, such as by having secure server racks, data centers, or individual case locks. A physical lock, such as a pin tumbler lock, can be an inexpensive deterrent to theft. Pin tumbler locks are cheap to manufacture and require only a key for access. However, pin tumbler locks can be fairly easy to defeat via picking and/or bumping.

BRIEF DESCRIPTION OF THE DRAWINGS

Various embodiments in accordance with the present disclosure will be described with reference to the drawings, in which.

DETAILED DESCRIPTION

Figure 1:
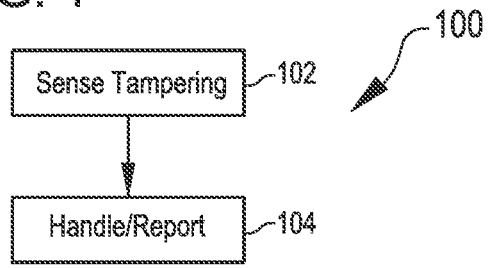
FIG. 1 is a flow chart showing a process for sensing and handling tampering of a lock in accordance with embodiments.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

In accordance with embodiments, physical locks are provided that include features for detecting tampering. The locks may be, for example, pin tumbler locks. Tampering may be detected in a number of different ways. As an example, abnormal movement of one or more of the driver pins in a pin tumbler lock can be an indication of tampering. In addition, one or more sensors can be included at the end of a keyway that detect picking or bumping beyond the length of normal key insertion. As other ways to detect tampering, excessive torque on a plug or vibration of the plug or lock can also be detected.

Sensors for detecting key tampering can be mechanical, such as an actuator, or can be electrical, such as optical sensors, pressure sensors, conductivity sensors, capacitive sensors, magnetic sensors, proximity sensors, rotation sensors, acceleration sensors, electromechanical switches, or movement detectors. If mechanical, a lever or other linkage can be connected to the driver pins or a keyway sensor, and an actuation of the lever or other device can cause a "mouse trap" release of a spring to lock out the pin tumbler lock and/or a door protected by the lock. Alternatively, the lever or other linkage can trigger a switch to perform another function, such as setting off an alarm or causing a solenoid to fire to lock the pin tumbler lock and/or the door. As an example, upon sensing tampering of a pin tumbler lock, a plunger pin may be moved to block out rotation of a plug for the pin tumbler lock. Alternatively, a lock that is separate from the pin tumbler lock, such as a deadbolt lock, can be actuated. In some embodiments, any key in the lock may be retained.

A signal received from an electronic sensor can be used, for example by a management component, in a number of different ways. As an example, in a master lock configuration, an audit of the particular key being used can be maintained and/or acted upon. A signal can be sent for door lockout and/or pin tumbler lockout. Software behind the lock can also be handled. For example, when tampering is detected, the management component can instruct automated destruction of software that is physically protected by the lock. As another option, an alarm can be sent to security and/or an administrator. In addition, as a result of receiving information about a tampering event, software or other material can be destroyed, privileges can be revoked, software can be encrypted, or software protected by the lock can otherwise be made inaccessible. Examples are described in U.S. application Ser. No. 13/765,020, filed Feb. 12, 2013, entitled "Data Security with a Security Module", incorporated herein by reference.

Locks described herein have particular application to protection of computer equipment and computer devices. The computer devices can be, for example, in a datacenter or other facility used to house computer systems and components. A datacenter can include rooms, which in turn include racks. The racks can include individual components, such as servers and/or network components. Any or all of these can be protected by the locks of the present system.

For example, the entire datacenter can include such a lock at a front door. Similar locks can be used at a room level. A rack may be any frame or enclosure capable of mounting one or more servers or other computing devices. In some applications, the rack can be a four-post server rack, a server cabinet, an open-frame two-post rack, a portable rack, a LAN rack, combinations of the same, or the like. Datacenter components that are maintained in a rack can be protected using one of the locks described herein.

Referring now to the drawings, in which like reference numerals represent like parts throughout the several views, FIG. 1 is a flowchart representing a process 100 for handling a tampering event with respect to a lock in accordance with embodiments.

At 102, tampering of a lock is sensed. This sensing can occur via one or more mechanical or electronic sensors, with some examples described below. At 104, the sensing event is handled or reported. In embodiments, if a mechanical sensor and lockout mechanism is used, handling can involve automated mechanical lockout of a door or the lock as a result of the tampering. If electronic sensing is utilized, then information can be provided to a management component, which can be hardware, software, or a combination of the two, and the management component can handle accordingly, for example by locking out the lock or reporting the tampering incident.

Figure 2:
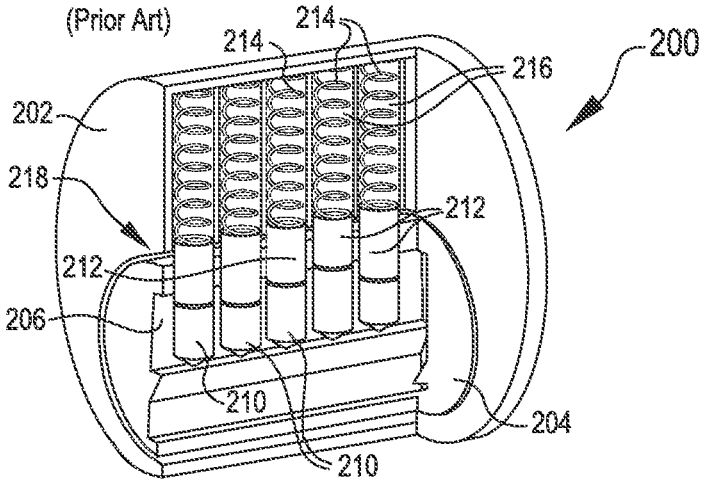
FIG. 2 (Prior Art)
FIG. 2 is a partial cutaway, perspective view of a prior art pin tumbler lock.
Figure 3:
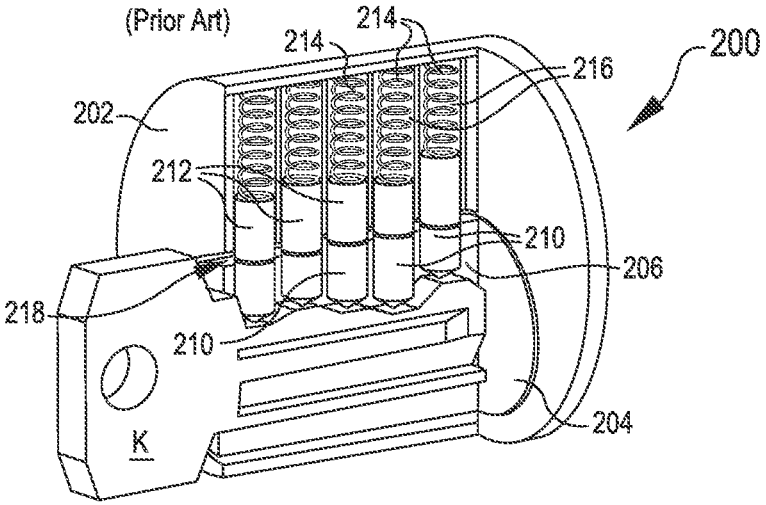
FIG. 3 (Prior Art)
FIG. 3 is a partial cutaway, perspective view of the prior art pin tumbler lock of FIG. 2, with a key inserted.
Figure 4:
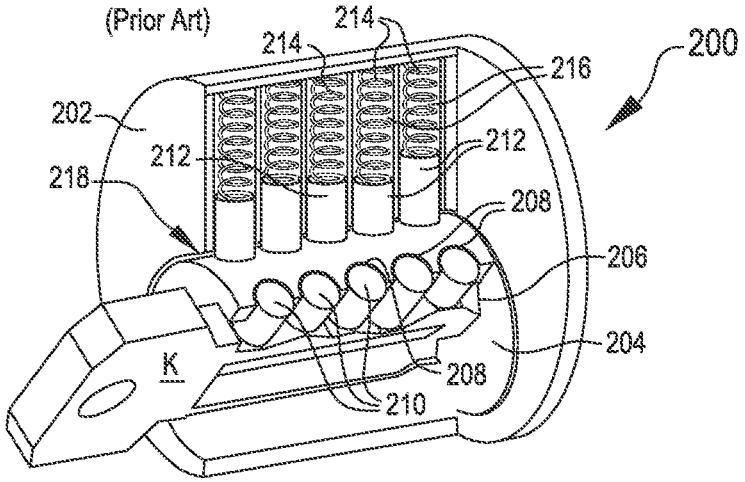
FIG. 4 (Prior Art)
FIG. 4 is a partial cutaway, perspective view of the prior art pin tumbler lock of FIGS. 2 and 3, with the key rotated.

Embodiments herein are directed to tamper detection and/or remediation for any type of lock, but specific embodiments are directed to pin tumbler locks. Although pin tumbler locks are known, details are provided here for the benefit of the reader. To this end, a prior art pin tumbler lock 200 is shown in FIGS. 2-4.

The pin tumbler lock 200 includes a cylindrical outer casing 202. The outer casing 202 has a cylindrical hole in which a plug 204 is housed. To open the pin tumbler lock 200, the plug 204 must rotate.

The plug 204 has a straight slot, called a "keyway" 206, extending through its center. During use, the keyway 206 receives a key K (FIG. 3), which unlocks the pin tumbler lock 200, and rotation of which rotates the plug 204 (FIG. 4). The distal end of the plug 204 typically includes a cam or lever (not shown) which actuates a mechanism to retract a locking bolt, for example, in a door (both not shown, but known). A series of holes or shafts 208 (FIG. 4), typically five or six in number, are drilled vertically into the plug 204. These shafts 208 include key pins 210 of various lengths, which are rounded at a bottom end to permit a key K to slide over the key pins when the key is entered into the keyway 206 (FIG. 3).

Above each key pin 210 is a corresponding driver pin 212. The driver pins 212 are biased downward by springs 214. The outer casing 202 includes several vertical shafts 216 for receiving the driver pins 212 and the springs 214. Simpler locks typically have only one driver pin 212 for each key pin 210, but locks requiring multi-key entry, such as a group of locks having a master key, may have one or more extra driver pins known as "spacer pins." This arrangement is not shown in FIGS. 2-4, but is known.

The point where the plug 204 and the cylindrical outer casing 202 meet is called a shear point 218. As shown in FIG. 2, when the plug 204 and the outer casing 202 are assembled, the key pins 210 are pushed down into the plug by the springs 214 and the driver pins 212. When the key K is not in the lock 200, the driver pins 212 straddle the shear point 218, preventing the plug 204 from rotating.

When a key K is properly cut and is fully inserted into the keyway 206, the key pins 210 rise against the bias of the springs 214. The length of the key pins 210 is such that the proper key causes the tops of the key pins to align at the shear point 218, as shown in FIG. 3. This allows the plug 204 to rotate (FIG. 4), thus opening the lock 200.

In the case of a lock that permits use of a master key, each outer casing 202 and plug 204 is configured such that each key that is not a master key causes the key pins 201 to rise to align at the shear point. The master key, on the other hand, causes the spacer pins (not shown) to align at the shear point 218. The master key may alternatively align some of the spacer pins and some of the key pins 210 at the shear point 218. In any event, the master key is capable of opening multiple different locks 200, whereas some keys are designed to open only a single lock or an identically-keyed set of locks.

There are two common methods of defeating a pin tumbler lock, such as the pin tumbler lock 200: picking and bumping. Picking involves inserting a pick and moving the key pins 210 upward and downward until the picker feels that the key pins 210 are aligned with the shear point 218. This often involves moving one pin at a time while tension is applied to keep the pins in position. In the course of picking, each driver pin 212 is raised further than its final height to set the pin. This action typically does not occur when a proper key is inserted. Instead, when the proper key is inserted, the driver pins 212 move no higher than pushed by the highest point on the key.

When a lock is bumped, a key filed to a certain pattern is inserted forcibly, causing all pins to fly up. Thus, bumping also results in the driver pins 212 moving higher than by a proper key.

In normal operation, with an authentic key K inserted into the keyway 206, each driver pin 212 is raised to a particular height determined by the key contour. In accordance with embodiments, to detect bumping or picking, one or more sensors are placed in the pin shaft(s) 216, on the driver pin(s) 212 or otherwise where the sensor(s) can sense driver pin 212 movements. If one or more of the driver pins 212 are raised further than expected by an authentic key, the sensor(s) can generate sensor event information and/or automatically cause handling or reporting of the sensed tampering activity.

As examples of handling of a sensor event, an alarm can be triggered or a mechanism can be triggered for inactivating the lock or a door that the lock protects. The inactivation mechanism can be, for example, an additional deadbolt or other lock for the door or other structure for which the lock 200 provides security. In addition, in accordance with embodiments, the inactivation mechanism can be an additional lockout feature on the pin tumbler lock for preventing rotation of the plug 204 relative to the outer casing 202.

Figure 5:
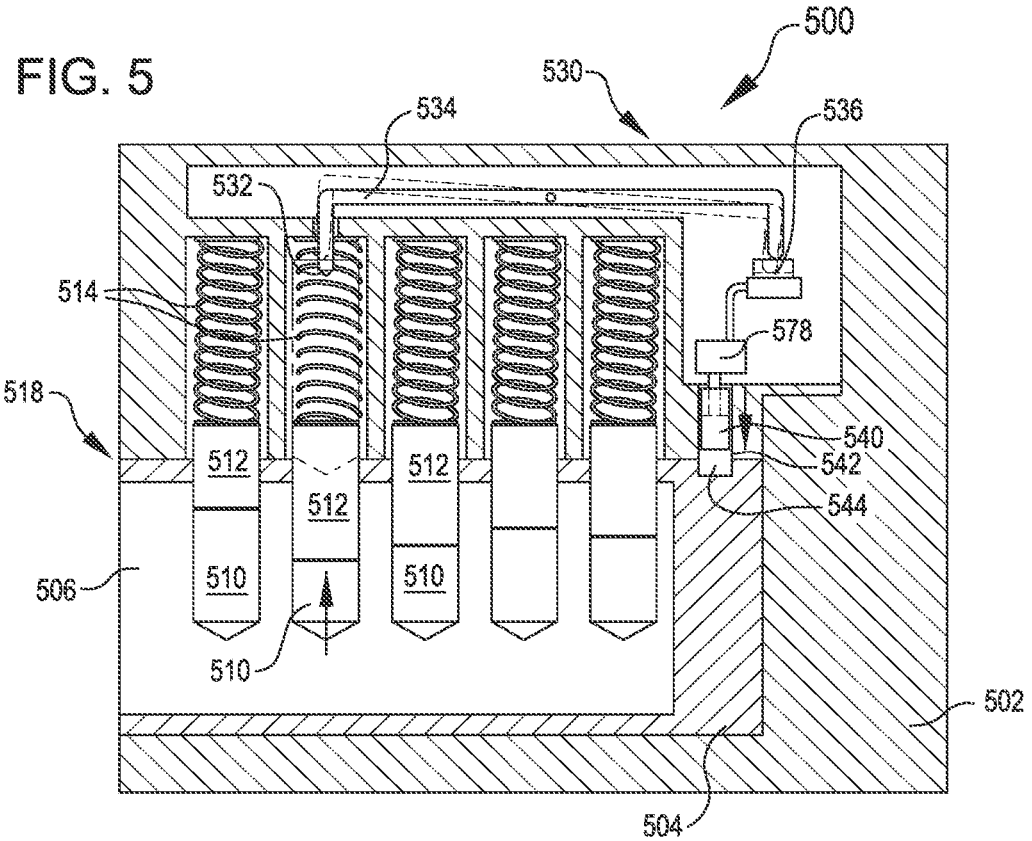
FIG. 5 is a partial cutaway, side view of a pin tumbler lock incorporating a mechanical sensing system in accordance with embodiments.

For example, as shown in FIG. 5, a lock 500 includes a sensor 530 mounted in an outer casing 502. For ease of description herein, the various embodiments of pin tumbler locks herein utilize like reference numerals for like parts throughout the several views to the prior art tumbler lock 200, with the numbers in the hundreds location changed for the different embodiments.

Thus, the lock 500 includes parts that are similar to the lock 200, and similar numbers are used for those parts, with "2" used in the hundreds place for the parts of the lock 200, and "5" used in the hundreds place for parts of the lock 500.

The sensor 530 is a mechanical sensor, which actually works as an actuator. By actuator, we mean a device or mechanism that takes action upon being actuated. Primarily, the actuators herein are devices or mechanisms that, upon sensing (typically by being moved), take action, such as flipping a switch or springing a trap or otherwise taking mechanical action.

In the lock 500, the sensor 530 includes a block 532 that is positioned in the path of one of the driver pins 512. Specifically, the block 532 is located at a position that is higher than where the driver pin 512 would travel under normal use (i.e., opening by an authentic key) but low enough to be engaged when the lock 500 is being picked or bumped. Thus, when the driver pin 512 is moved too far upward relative to normal, it engages the block 532. Similar blocks 532 and sensors 530 can be provided for additional driver pins 512.

The block 532 connects to a lever arm 534. Movement of the driver pin 512 upward to an extent beyond what is normal operation causes the block 532 to be engaged, and the lever arm 534 to rotate. A distal end of the lever arm 534 engages a switch 536, which may be, for example, a switch. The switch 536 in turn actuates a solenoid 538, which drives a plunger pin 540 through a shaft 542 and into an opening 544 in the plug 504. The plunger pin 540 straddles the shear point 518 and thus locks the plug 504 from rotation. As an alternative to the solenoid, a linear actuator can be used for lockout.

The sensor 530 shown in FIG. 5 thus can automatically disable the lock 500 as a result of sensing tampering, in this case by sensing overtravel of one of the driver pins 512. As discussed above, such a system can be set up so that excessive travel or movement of any of the driver pins 512 can cause a similar reaction.

Although shown as using a solenoid 538, other structures can be used for locking movement of the plug 504. For example, a mousetrap type of system can be used in which a spring is positioned behind the plunger pin 540 and the spring is released upon contact by the lever arm 534. In embodiments, however, the plunger pin 540 engages and locks the plug 504 in a position remote from the keyway 506. This feature ensures that a picker or bumper cannot have access to the plunger pin 540 through the keyway 506.

Other mechanical linkages can be provided to connect a driver pin sensor to locking of the plug 502 or some other handler, such as a deadbolt in a door in which the lock 500 is installed. In general, such linkages translate excessive travel of one of the driver pins 512 into a movement that can lockout or otherwise handle the tampering event. A mechanical linkage can, for example, cause locking of a deadbolt that is separate from the lock 500. The mechanical linkage can also engage a switch to set off an alarm, or can otherwise mechanically react to tampering of the lock 500.

Figure 6:
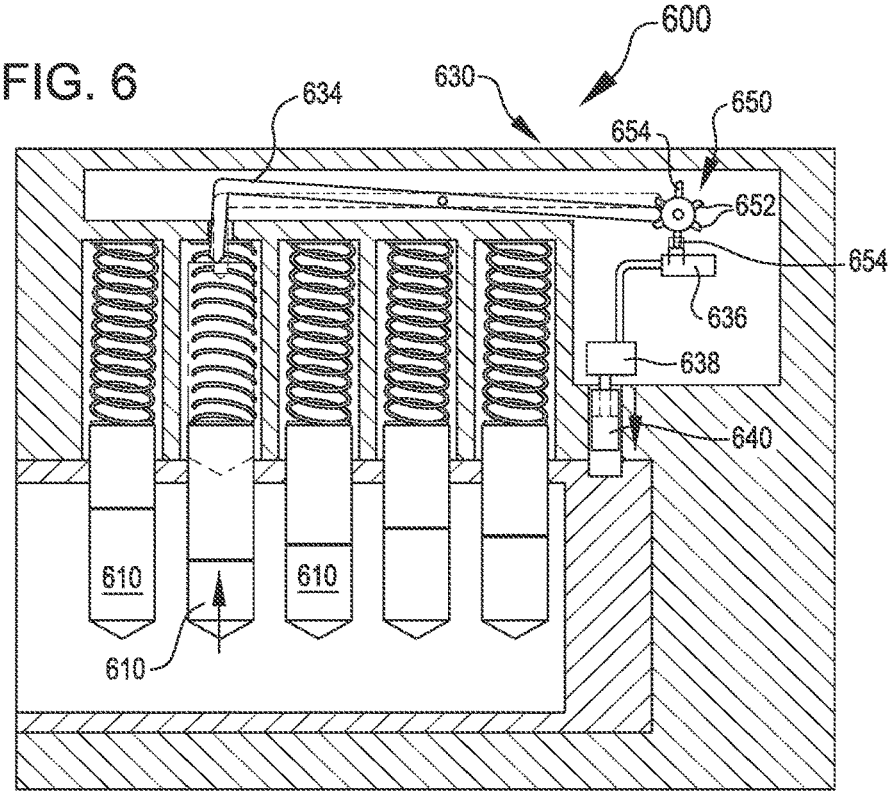
FIG. 6 is a partial cutaway, side view of an alternate embodiment of a pin tumbler lock incorporating a mechanical sensing system in accordance with embodiments.

In embodiments, a sensor can react to multiple incidents of excessive travel of a driver pin 512, instead of only a single incident. This arrangement can prevent a single occurrence from accidentally locking out the lock. For example, FIG. 6 shows an embodiment of a lock 600 which is similar to the lock 500 in FIG. 5. However, instead of causing direct actuation of the plunger pin 540, the lock 600 includes an indexing mechanism 650 that is engaged by a lever arm 634. The indexing mechanism 650 includes several teeth 652, 654. When the lever arm rocks, it engages one of the teeth 652, 654 and indexes the indexing mechanism a distance of the tooth. Every third tooth 654 is long, with the intermediate teeth 652 being short. The long teeth 654 can actuate a switch 536, but the short teeth 652 are too short to engage the switch.

Utilizing the structure in FIG. 6, the plunger 640 is actuated on every third sensing of excessive travel of the driver pin 612. Thus, accidental sensing can be eliminated and only when excessive tampering takes place does the sensor 630 result in lockout of the lock 600.

Figure 7:
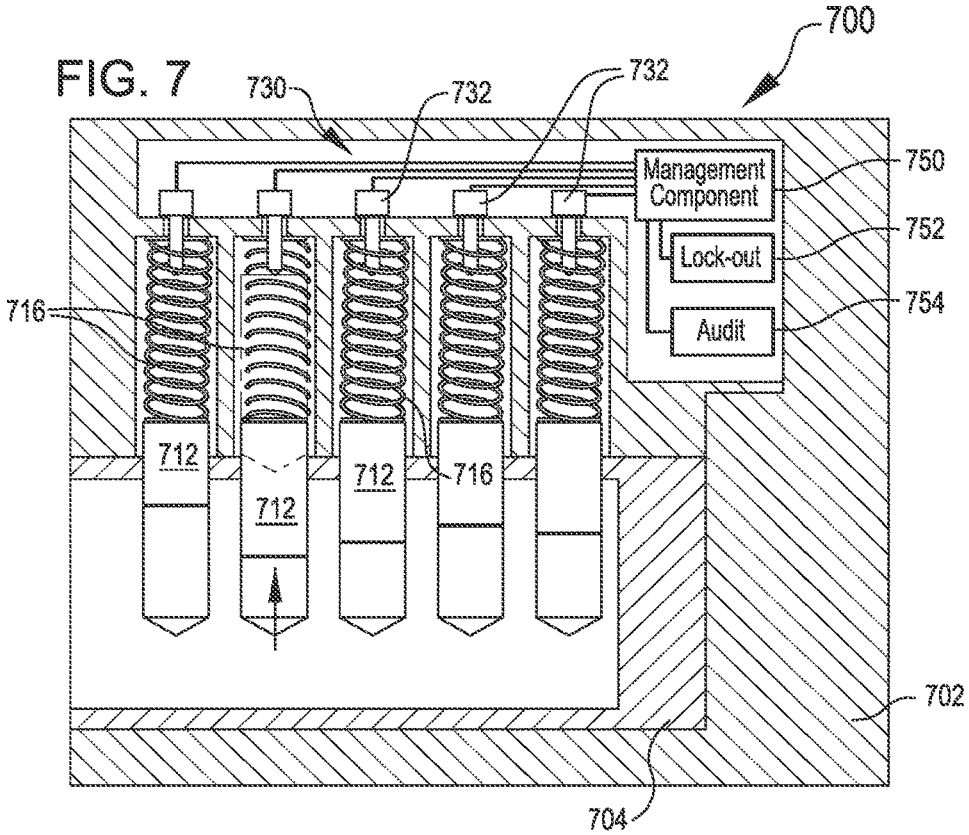
FIG. 7 is a partial cutaway, side view of a pin tumbler lock incorporating an electrical sensing system in accordance with embodiments.

As an alternative to mechanical sensing and coupling of a sensor to driver pin movement, electrical sensing of excessive driver pin movement can be used, and the signals generated by the electronic sensors can be acted on according to a plan or routine. As an example, as shown in FIG. 7, a sensor 730 includes electronic sensors 732, one each for the driver pin shafts 516. Although a separate electronic sensor 732 is shown for each of the driver pins 712, only one or any subset of the driver pins 712 can be sensed.

The electronic sensors 732 can be optical sensors, pressure sensors, movement sensors, or any other sensor that can provide a signal or information in response to movement of a driver pin 512. In embodiments, the information is provided to a management component 750. The management component 750 can be a computer or any micro-controller that can perform the lockout, inactivation, messaging or other handling features described herein. In embodiments, the management component 750 can be coupled to a lockout mechanism 752, which can be structured to provide lockout of the lock 750 or an alternative lockout for a door that the lock is designed to secure. The management component 750 can also be coupled to an audit component 754, which can maintain and/or report information about the sensed event information received by the management component.

The electronic sensor 730 in FIG. 7 can be utilized for a number of different functions. As an example, as described above, tampering can be detected, for example by sensing that one or more driver pins 712 are pushed above their normal limits. In addition, for a lock that can receive multiple key patterns, a particular key that is used can be detected and can be authorized or not, based on information maintained by the management component 750. Thus, in some situations, such as a lockdown of a datacenter, only a master key or certain authorized keys may be provided access. Thus, the electronic sensors 712 provide information to the management component 750 based upon travel of the driver pins 712. This information is checked against stored data to determine which key is being used, and authorization is provided or not based upon the current authorization associated with the key. In some embodiments, certain keys may be operable to reset the tamper lockout. In some embodiments, a particular sequence of such keys may be required to reset the lockout.

The management component 750 can receive data from a number of sensors, correct errors and reconcile data from one source to that of another, maintain and/or retrieve authorization information about keys and/users, generate instructions on handling of locks, alarms or other features described herein. The management component 750 can reconcile the data received from the disparate sources, and generate instructions for handling the lock or associated components as needed. In some embodiments, the management component 750 can generate an alert to request human interaction with the device, for example in accordance with a playbook. In other embodiments, the management component 750 can generate instructions that are received by the lock or other components to cause the components to react accordingly, e.g., to change state and/or operation.

The management component 750 can be a computing device, such as a microprocessor, configured with various hardware and software modules to implement the processes described herein. In embodiments, the management component 750 can be physically located within a lock, physically connected to the lock, or can be remotely located from a lock. In some embodiments, the management component 750 can be remote from the lock and even the building in which the lock in located. A single management component can also manage a number of locks, and can be connected to those locks or positioned remotely of those locks. In addition, reporting functions of the management component can be processed, presented, or reported on by the management component, or can be sent to a centralized management component for processing or handling.

Figure 8:
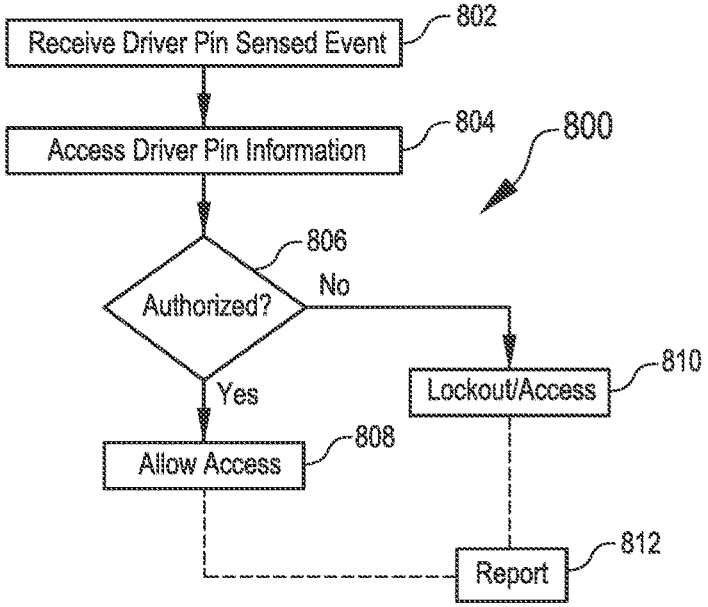
FIG. 8 is a flow chart showing a process for handling sensed tampering information in accordance with embodiments.

FIG. 8 shows a process 800 for controlling operation of a lock, such as the lock 700, utilizing an electronic sensor, such as the electronic sensor 730. Many of the functions of FIG. 8 are performed by the management component 750.

Beginning at 802, the management component 750 receives driver pin sensed event information. For example, the amount each of the driver pins 712 moves in corresponding shafts 716 can be provided to the management component 750. At 804, the management component accesses driver pin information to determine what action to take with respect to the lock 700 in accordance with the information received at 802. If the driver pin information indicates that the movement is an authorized movement, then 806 branches to 808, where the lock is allowed to be opened or other authorized movement is permitted. If the information received at 804 does not indicate authorization, then 806 branches to step 810, where the lock 700 is locked out, an alarm sounds, or other action is taken. As indicated above, a number of different options are provided for locking out the lock 700. In addition, as opposed to a lockout, an alarm can be sounded or other alert.

In still further embodiments, information can be sent by the management component 750 to software, with instructions for software or other material to be destroyed, privileges to be revoked, software and/or data to be encrypted, and/or software protected by the lock can otherwise be made inaccessible.

At 812, after either allowing access or providing lockout or otherwise handling, the information can be reported or otherwise stored. For example, the management component 750 can maintain information about the number of uses of a particular key, whether a key is a master key that is being used, or other information. In addition, the type of authorization permitted can be altered based upon whether a key is a master key or a different type of key.

Figure 9:
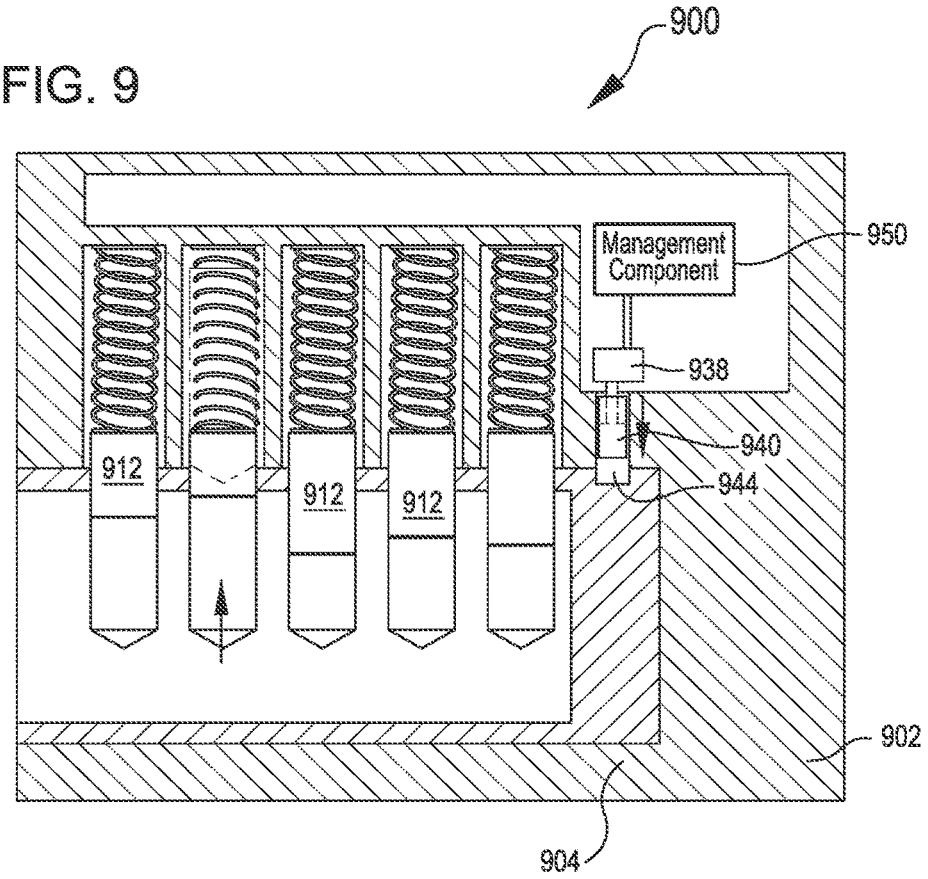
FIG. 9 is a partial cutaway, side view of a pin tumbler lock incorporating a lockout component in accordance with embodiments.

As described above, a plunger pin, such as the plunger pin 640, can be used to lockout the plug 604 from rotation. As discussed above, one benefit to the location of the plunger pin 640 is that it cannot be accessed from the keyway 606. In embodiments, such a plunger pin 640 or other lockout mechanism can be utilized with or without sensing mechanisms. As an example, as shown in FIG. 9, a plunger pin 940 can be utilized with a plug 904. This plunger 940 can be connected, for example, to a management component 950 which determines when the solenoid 938 fires. The management component 950 can, for example, lock out the plug 904 as a result of an emergency. As another option, a plug 904 can be locked during a period of time to allow completion of a maintenance routine on a computer protected by the plug.

In most of the embodiments herein, the plunger pin 940 is normally unlocked. Alternatively, the plunger pin 940 can be normally locked in position, and action may be required to permit release. When an alarm condition is detected, it can be desirable to prevent opening of the lock 900. The plunger pin 940 can be used to lock out the lock 90 in such an alarm situation.

In addition, the plunger pin 940 can be utilized to require multi-factor authentication to open the lock 900. For example, in addition to requiring a proper key to turn the lock 900, the plunger pin 940 can be operated in accordance with another security authorization, such as bio-informatics or an RFID (radio frequency identification) tag positioned within the key and read by a RFID reader in or near the lock 900.

Thus, to open the lock 900, two requirements must be met. First, the plunger pin 940 must be removed from the opening 944. Second, the proper key must be inserted in the keyway 906. Both of these must occur for the plug 904 to be rotatable. As such, multiple security features are provided by the plunger pin 940/management module 950 over a standard pin tumbler lock. In alternate embodiments, the plunger pin 940 (or some other lockout mechanism) can be normally locked, and some action, such as authentication via RFID or some other security clearance, is required to unlock the pin or lock mechanism prior to the pin or lock mechanism releasing to allow key access.

An advantage of the plunger 940 is that it is positioned beyond and is not accessible from the keyway 906. Thus, a potential intruder trying to pick the lock 900 cannot access the plunger 904.

Figure 10:
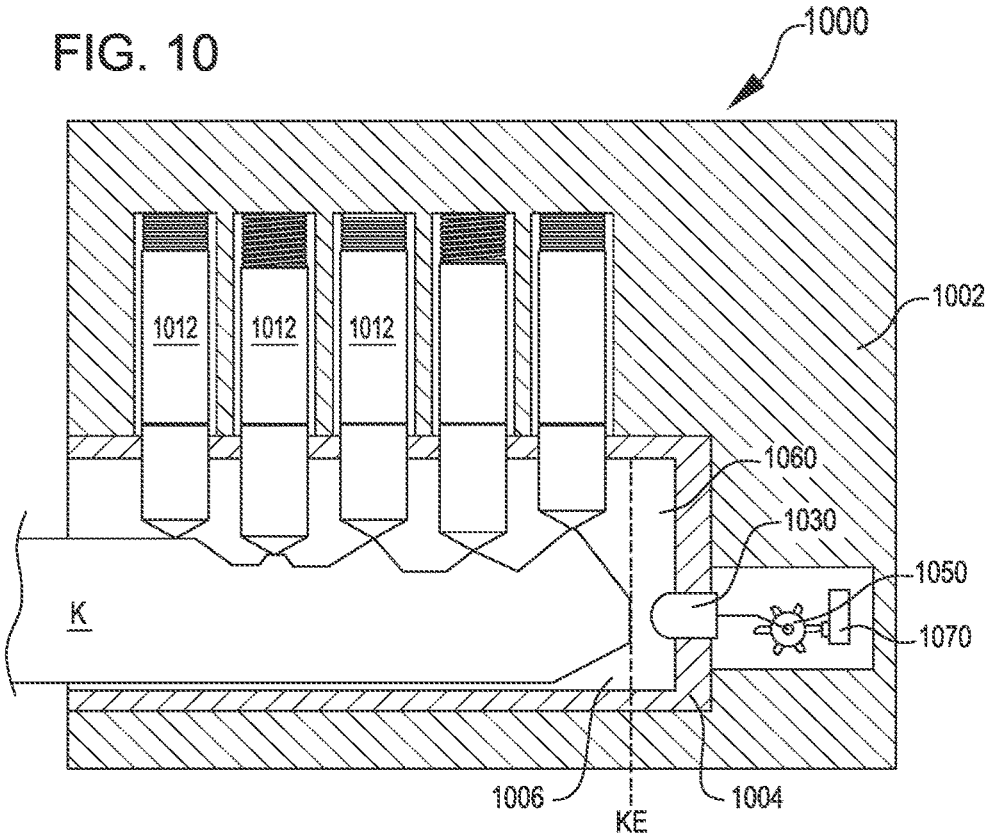
FIG. 10 is a partial cutaway, side view of a pin tumbler lock incorporating a mechanical sensing system at the end of a keyway in accordance with embodiments.

In accordance with embodiments, picking or bumping can also be detected by providing a sensor that is located at a position in the keyway and that is beyond a key end for an authentic key. For example, as shown in FIG. 10, a lock 1000 includes a keyway 1006 with a distal end 1060 that is beyond the key end KE of a key K that is inserted into the keyway. Thus, under normal operation of the lock 1000, the key K does not extend into the distal end 1060. However, on picking or bumping, a potential intruder may extend a pick or bumping key beyond the key end KE to the distal end 1060 of the keyway 1006. To sense such a situation, the lock 100 includes a sensor 1030, which can be any of the electrical or mechanical sensors described herein. In the embodiment shown in FIG. 10, the sensor 1030 is a mechanical actuator that, upon being contacted by a pick or bumping key or other tool, rotates an indexing mechanism 1050, similar to the indexing mechanism 650. This indexing mechanism 1050 actuates a switch 1070 on every third engagement with the indexing mechanism 1050. The switch 1070 handles accordingly, as described above.

Figure 11:
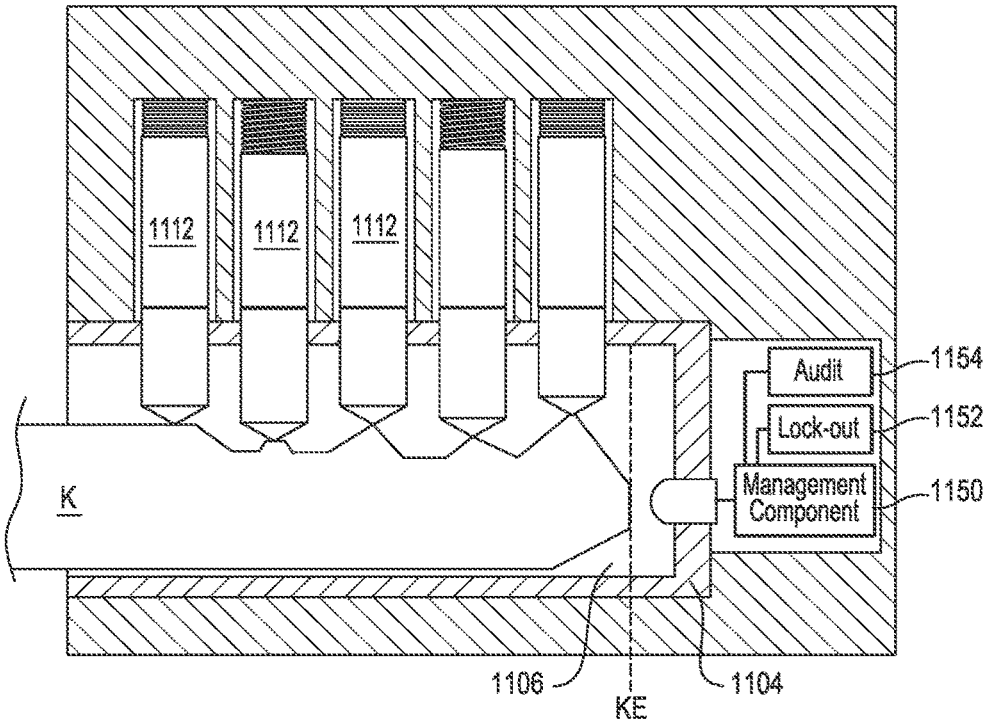
FIG. 11 is a partial cutaway, side view of a pin tumbler lock incorporating an electrical sensing system at the end of a keyway in accordance with embodiments.

As an alternative to the indexing mechanism 1050, the sensor 1030 can provide an immediate response to engagement by a tool in the distal end 1060 of the keyway 1006. In a similar manner, as shown in FIG. 11, instead of a mechanical switch, an electrical sensor 1130 can be provided that connected to a management component 1150. The function of the management component 1150 can be similar to the management component 750, described above. As with the management component 750, the management component 1150 can be connected to at least one of a lockout component 1152 and an audit component 1154.

In accordance with additional embodiments, the use of a self-winding or generator mechanism can be used with a cylinder lock, such as the pin tumbler locks described herein. Energy from the mechanism can be used to selfpower the electronic and/or mechanical mechanisms, such as the sensors, described herein.

Figure 12:
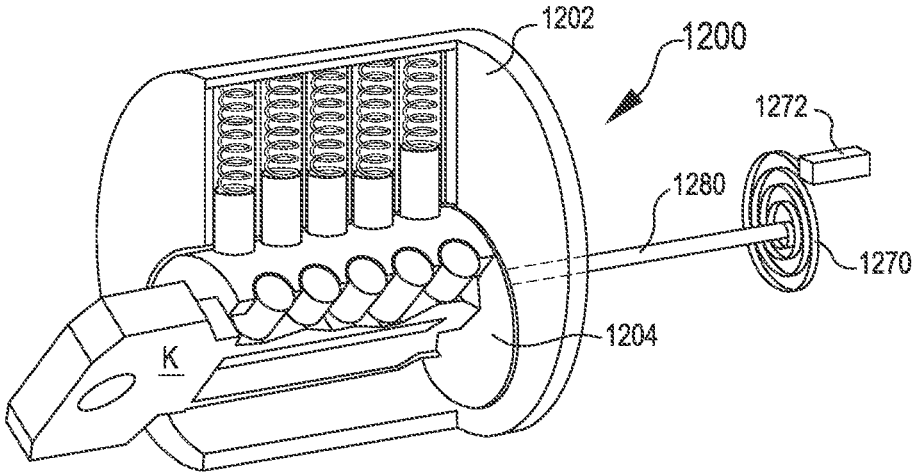
FIG. 12 is a partial cutaway, perspective view of a pin tumbler lock utilizing a self-winding mechanism in accordance with embodiments.

For example, as shown in FIG. 12, a lock can include a spring 1270 connected to the back, distal end of the plug 1204. The spring 1270 is connected to a block 1272. The spring 1270 can be, for example, a spiral torsion spring of metal ribbon and can be the power source for the locks for many of the embodiments described herein. To this end, the spring 1270 is used in a manner that is similar to winding springs for watches. For example, power stored in the spiral torsion spring can be utilized to power the solenoids 538, 638. The spring 1270 may be similar to a modern mainspring, and can be coiled and wound by operation of a user rotating the plug 1204 with the key K.

Operation of mainsprings is known, but some detail is given here for the benefit of the reader. The mainspring is coiled around an axle called the arbor 1280, with the inner end hooked to the arbor. The outer end is attached to a stationary post, such as the block 1272. The spring is wound by turning the arbor, which in this case is connected to the plug 1204. The wound spring energy can then be used to power the components of the lock 1200. The winding mechanism includes a ratchet attached with a pawl to prevent the spring from unwinding.

Some or all of the process 200, 800 (or any other processes or functions described herein, or variations and/or combinations thereof) may be performed under the control of one or more computer systems configured with executable instructions and may be implemented as code (e.g., executable instructions, one or more computer programs or one or more applications) executing collectively on one or more processors, by hardware or combinations thereof. The code may be stored on a computer-readable storage medium, for example, in the form of a computer program comprising a plurality of instructions executable by one or more processors. The computer-readable storage medium may be non-transitory.

Figure 13:
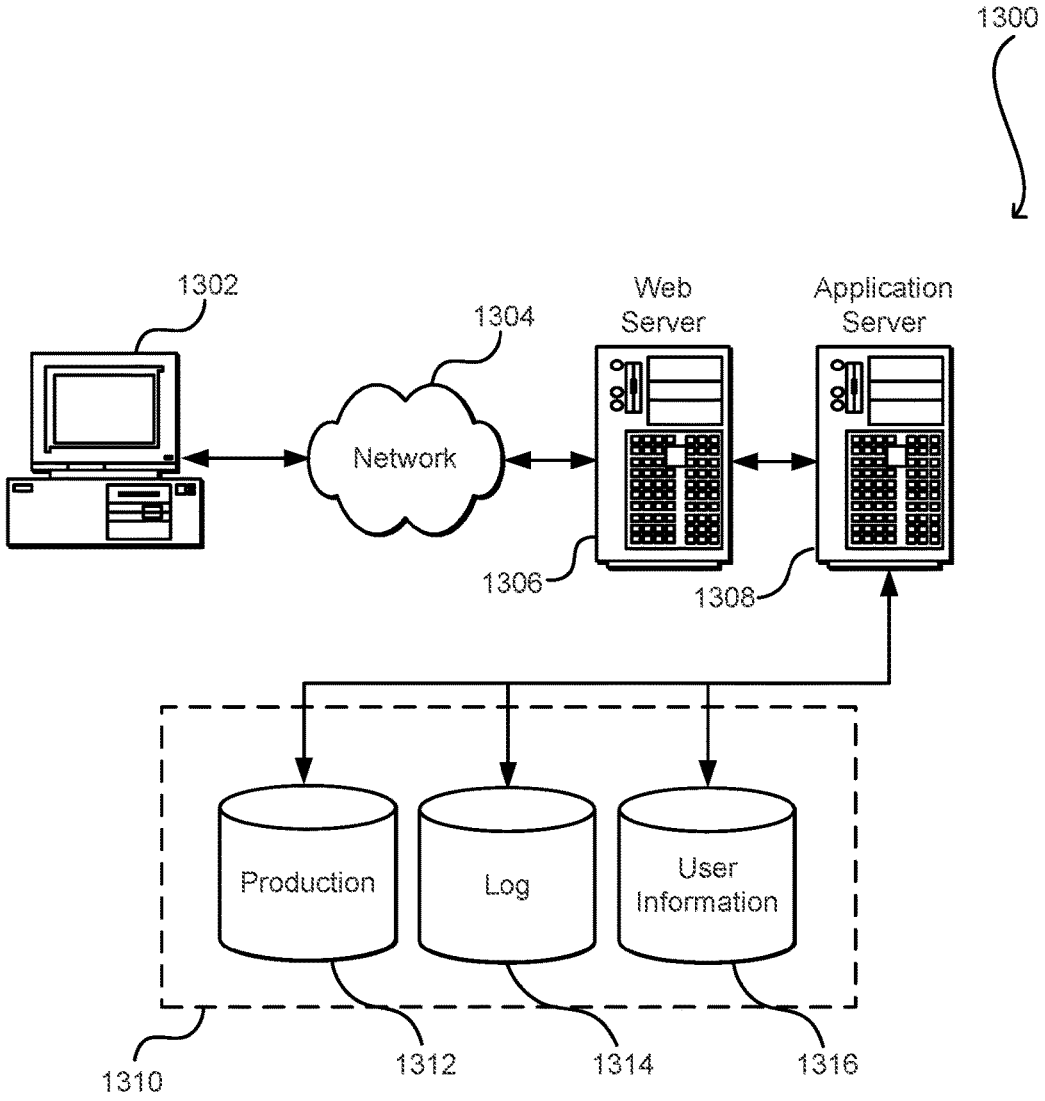
FIG. 13 illustrates an environment in which various embodiments can be implemented.

FIG. 13 illustrates aspects of an example environment 1300 for implementing aspects in accordance with various embodiments. As will be appreciated, although a Web-based environment is used for purposes of explanation, different environments may be used, as appropriate, to implement various embodiments. The environment includes an electronic client device 1302, which can include any appropriate device operable to send and receive requests, messages or information over an appropriate network 1304 and convey information back to a user of the device. Examples of such client devices include personal computers, cell phones, handheld messaging devices, laptop computers, set-top boxes, personal data assistants, electronic book readers and the like. The network can include any appropriate network, including an intranet, the Internet, a cellular network, a local area network or any other such network or combination thereof. Components used for such a system can depend at least in part upon the type of network and/or environment selected. Protocols and components for communicating via such a network are well known and will not be discussed herein in detail. Communication over the network can be enabled by wired or wireless connections and combinations thereof. In this example, the network includes the Internet, as the environment includes a Web server 1306 for receiving requests and serving content in response thereto, although for other networks an alternative device serving a similar purpose could be used as would be apparent to one of ordinary skill in the art.

The illustrative environment includes at least one application server 1308 and a data store 1310. It should be understood that there can be several application servers, layers, or other elements, processes or components, which may be chained or otherwise configured, which can interact to perform tasks such as obtaining data from an appropriate data store. As used herein the term "data store" refers to any device or combination of devices capable of storing, accessing and retrieving data, which may include any combination and number of data servers, databases, data storage devices and data storage media, in any standard, distributed or clustered environment. The application server can include any appropriate hardware and software for integrating with the data store as needed to execute aspects of one or more applications for the client device, handling a majority of the data access and business logic for an application. The application server provides access control services in cooperation with the data store and is able to generate content such as text, graphics, audio and/or video to be transferred to the user, which may be served to the user by the Web server in the form of HyperText Markup Language ("HTML"), Extensible Markup Language ("XML") or another appropriate structured language in this example. The handling of all requests and responses, as well as the delivery of content between the client device 1302 and the application server 1308, can be handled by the Web server. It should be understood that the Web and application servers are not required and are merely example components, as structured code discussed herein can be executed on any appropriate device or host machine as discussed elsewhere herein.

The data store 1310 can include several separate data tables, databases or other data storage mechanisms and media for storing data relating to a particular aspect. For example, the data store illustrated includes mechanisms for storing production data 1312 and user information 1316, which can be used to serve content for the production side. The data store also is shown to include a mechanism for storing log data 1314, which can be used for reporting, analysis or other such purposes. It should be understood that there can be many other aspects that may need to be stored in the data store, such as for page image information and to access right information, which can be stored in any of the above listed mechanisms as appropriate or in additional mechanisms in the data store 1310. The data store 1310 is operable, through logic associated therewith, to receive instructions from the application server 1308 and obtain, update or otherwise process data in response thereto. In one example, a user might submit a search request for a certain type of item. In this case, the data store might access the user information to verify the identity of the user and can access the catalog detail information to obtain information about items of that type. The information then can be returned to the user, such as in a results listing on a Web page that the user is able to view via a browser on the user device 1302. Information for a particular item of interest can be viewed in a dedicated page or window of the browser.

Each server typically will include an operating system that provides executable program instructions for the general administration and operation of that server and typically will include a computer-readable storage medium (e.g., a hard disk, random access memory, read only memory, etc.) storing instructions that, when executed by a processor of the server, allow the server to perform its intended functions. Suitable implementations for the operating system and general functionality of the servers are known or commercially available and are readily implemented by persons having ordinary skill in the art, particularly in light of the disclosure herein.

The environment in one embodiment is a distributed computing environment utilizing several computer systems and components that are interconnected via communication links, using one or more computer networks or direct connections. However, it will be appreciated by those of ordinary skill in the art that such a system could operate equally well in a system having fewer or a greater number of components than are illustrated in FIG. 13. Thus, the depiction of the system 1300 in FIG. 13 should be taken as being illustrative in nature and not limiting to the scope of the disclosure.

Some various embodiments further can be implemented in a wide variety of operating environments, which in some cases can include one or more user computers, computing devices or processing devices which can be used to operate any of a number of applications. User or client devices can include any of a number of general purpose personal computers, such as desktop or laptop computers running a standard operating system, as well as cellular, wireless and handheld devices running mobile software and capable of supporting a number of networking and messaging protocols. Such a system also can include a number of workstations running any of a variety of commercially-available operating systems and other known applications for purposes such as development and database management. These devices also can include other electronic devices, such as dummy terminals, thin-clients, gaming systems and other devices capable of communicating via a network.

Some embodiments utilize at least one network that would be familiar to those skilled in the art for supporting communications using any of a variety of commercially-available protocols, such as Transmission Control Protocol/Internet Protocol ("TCP/IP"), File Transfer Protocol ("FTP"), Universal Plug and Play ("UpnP"), Network File System ("NFS"), and Common Internet File System ("CIFS"). The network can be, for example, a local area network, a wide-area network, a virtual private network, the Internet, an intranet, an extranet, a public switched telephone network, an infrared network, a wireless network and any combination thereof.

In embodiments utilizing a Web server, the Web server can run any of a variety of server or mid-tier applications, including Hypertext Transfer Protocol ("HTTP") servers, FTP servers, Common Gateway Interface ("CGI") servers, data servers, Java servers and business application servers. The server(s) also may be capable of executing programs or scripts in response requests from user devices, such as by executing one or more Web applications that may be implemented as one or more scripts or programs written in any programming language, such as Java®, C, C# or C++, or any scripting language, such as Perl, Python or TCL, as well as combinations thereof. The server(s) may also include database servers, including without limitation those commercially available from Oracle®, Microsoft®, Sybase® and IBM®.

The environment can include a variety of data stores and other memory and storage media as discussed above. These can reside in a variety of locations, such as on a storage medium local to (and/or resident in) one or more of the computers or remote from any or all of the computers across the network. In a particular set of embodiments, the information may reside in a storage-area network ("SAN") familiar to those skilled in the art. Similarly, any necessary files for performing the functions attributed to the computers, servers or other network devices may be stored locally and/or remotely, as appropriate. Where a system includes computerized devices, each such device can include hardware elements that may be electrically coupled via a bus, the elements including, for example, at least one central processing unit ("CPU"), at least one input device (e.g., a mouse, keyboard, controller, touch screen or keypad) and at least one output device (e.g., a display device, printer or speaker). Such a system may also include one or more storage devices, such as disk drives, optical storage devices and solid-state storage devices such as random access memory ("RAM") or read-only memory ("ROM"), as well as removable media devices, memory cards, flash cards, etc.

Such devices also can include a computer-readable storage media reader, a communications device (e.g., a modem, a network card (wireless or wired), an infrared communication device, etc.) and working memory as described above. The computer-readable storage media reader can be connected with, or configured to receive, a computer-readable storage medium, representing remote, local, fixed and/or removable storage devices as well as storage media for temporarily and/or more permanently containing, storing, transmitting and retrieving computer-readable information. The system and various devices also typically will include a number of software applications, modules, services or other elements located within at least one working memory device, including an operating system and application programs, such as a client application or Web browser. It should be appreciated that alternate embodiments may have numerous variations from that described above. For example, customized hardware might also be used and/or particular elements might be implemented in hardware, software (including portable software, such as applets) or both. Further, connection to other computing devices such as network input/output devices may be employed.

Storage media and computer readable media for containing code, or portions of code, can include any appropriate media known or used in the art, including storage media and communication media, such as but not limited to volatile and non-volatile, removable and non-removable media implemented in any method or technology for storage and/or transmission of information such as computer readable instructions, data structures, program modules or other data, including RAM, ROM, Electrically Erasable Programmable Read-Only Memory ("EEPROM"), flash memory or other memory technology, Compact Disc Read-Only Memory ("CD-ROM"), digital versatile disk (DVD) or other optical storage, magnetic cassettes, magnetic tape, magnetic disk storage or other magnetic storage devices or any other medium which can be used to store the desired information and which can be accessed by the a system device. Based on the disclosure and teachings provided herein, a person of ordinary skill in the art will appreciate other ways and/or methods to implement the various embodiments.

The specification and drawings are, accordingly, to be regarded in an illustrative rather than a restrictive sense. It will, however, be evident that various modifications and changes may be made thereunto without departing from the broader spirit and scope of the invention as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions and equivalents falling within the spirit and scope of the invention, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this disclosure are described herein, including the best mode known to the inventors for carrying out the invention. Variations of those preferred embodiments may become apparent to those of ordinary skill in the art upon reading the foregoing description. The inventors expect skilled artisans to employ such variations as appropriate and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications and patents, cited herein are hereby incorporated by reference to the same extent as if each reference were individually and specifically indicated to be incorporated by reference and were set forth in its entirety herein.

What is claimed is:

1. A pin tumbler lock, comprising:

a body;

a plug rotatingly mounted in the body and comprising a keyway for receiving a key;

a key end defined in the keyway that corresponds to the end of a key inserted into the keyway when said key is positioned in a proper position to rotate the plug relative to the body;

an actuator in the keyway positioned distal of the key end from an opening in the keyway, and configured and positioned to actuate in response to engagement with a foreign body inserted in the keyway when the foreign body extends beyond the key end; and a lockout mechanism, connected to the actuator, and configured to lock rotation of the plug in response to the actuator actuating.

2. The pin tumbler lock of claim 1, wherein the lockout mechanism is configured to cause the keyway to retain an unauthorized key when the lockout mechanism locks rotation of the plug.

3. The pin tumbler lock of claim 2, wherein the actuator is configured to flip a switch to cause lockout of the plug relative to the body in response to said rotation.

4. The pin tumbler lock of claim 2, wherein actuation of the actuator causes a solenoid to fire and move a pin into position to straddle the body and the plug, preventing rotation of the plug.

5. The pin tumbler lock of claim 4, further comprising an indexing mechanism, wherein actuation of the actuator causes the indexing mechanism to index, and the indexing mechanism causes the solenoid to fire at intervals of being indexed.

6. The pin tumbler lock of claim 1, wherein the lockout mechanism is configured to lock a door that the pin tumbler lock secures.

7. The pin tumbler lock of claim 1, wherein the actuator is configured to set off an alarm in response to being actuated.

8. The pin tumbler lock of claim 1, wherein the lockout mechanism is configured to lock rotation of the plug while the plug is stationary in the body.

9. The pin tumbler lock of claim 1, wherein the lockout mechanism is configured to lock rotation of the plug only in response to the actuator actuating.

10. A pin tumbler lock, comprising:

a body;

a plug rotatingly mounted in the body and comprising a keyway for receiving a key;

a key end defined in the keyway that corresponds to the end of a key inserted into the keyway when said key is positioned in a proper position to rotate the plug relative to the body; and an actuator in the keyway positioned distal of the key end from an opening in the keyway, and configured to engage one of an improper key and a picking device when the one of the improper key or picking device is inserted in the keyway and extends beyond the key end, without engaging an authorized key when the authorized key is inserted in the keyway.

11. The pin tumbler lock of claim 10, further comprising:

a lockout mechanism configured to lock rotation of the plug in response to the actuator actuating.

12. The pin tumbler lock of claim 10, further comprising:

an indexing mechanism connected with the actuator and configured to record a tampering attempt in response to the actuator engaging the one of an improper key and a picking device.

13. The pin tumbler lock of claim 12, further comprising:

a lockout mechanism connected with the indexing mechanism and configured to lock rotation of the plug in response to the indexing mechanism recording a predetermined number of tampering attempts.

14. The pin tumbler lock of claim 10, wherein the actuator is positioned in the keyway distal of a key end of an authorized key when said authorized key is positioned in a proper position to rotate the plug relative to the body.

15. The pin tumbler lock of claim 10, further comprising:

a lockout mechanism configured to lock rotation of the plug in response to the actuator sensing excessive tampering.

16. The pin tumbler lock of claim 10, further comprising:

an audit component connected with the actuator and configured to record event information based in part on the actuator actuating, and configured to maintain the event information.

17. The pin tumbler lock of claim 10, wherein the actuator is configured to actuate only in response to sensing picking or bumping beyond a length of a normal key insertion.

18. A pin tumbler lock, comprising:

a body;

a plug rotatingly mounted in the body and comprising a keyway for receiving a key;

a key end defined in the keyway that corresponds to the end of a key inserted into the keyway when said key is positioned in a proper position to rotate the plug relative to the body;

an actuator in the keyway positioned distal of the key end from an opening in the keyway and configured to engage with a foreign body inserted in the keyway when the foreign body extends beyond the key end, and an indexing mechanism mechanically linked with the actuator, wherein the indexing mechanism is configured to index in response to the actuator actuating.

19. The pin tumbler lock of claim 18, further comprising a lockout mechanism configured to lock rotation of the plug in response to the indexing mechanism indexing a predetermined number of times.

20. The pin tumbler lock of claim 18, wherein:

the lockout mechanism comprises a plurality of teeth, the plurality of teeth comprising at least one short tooth and at least one long tooth, the at least one long tooth being operable to actuate a switch;

the indexing mechanism is configured to move a distance of one of the at least one short tooth and at least one long tooth when the indexing mechanism indexes; and the indexing mechanism is configured to actuate the switch by one of the at least one long tooth when the indexing mechanism has indexed the predetermined number of times.

* * * * *